US008107854B2

(12) United States Patent
Jang

(10) Patent No.: US 8,107,854 B2
(45) Date of Patent: Jan. 31, 2012

(54) IMAGE FORMING APPARATUS

(75) Inventor: Myoung Sub Jang, Suweon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 436 days.

(21) Appl. No.: 12/468,312

(22) Filed: May 19, 2009

(65) Prior Publication Data

US 2009/0317128 A1 Dec. 24, 2009

(30) Foreign Application Priority Data

Jun. 18, 2008 (KR) ..... 10-2008-0057391

(51) Int. Cl.
*G03G 15/00* (2006.01)

(52) U.S. Cl. ..... 399/110; 399/114

(58) Field of Classification Search ..... 399/107, 399/110–114, 124, 297, 299, 302, 308; 347/115
See application file for complete search history.

(56) References Cited

U.S. PATENT DOCUMENTS

| | | | | |
|---|---|---|---|---|
| 6,968,142 | B2 * | 11/2005 | Arimitsu et al. | 399/114 |
| 7,113,199 | B2 * | 9/2006 | Hattori et al. | 347/115 |
| 7,136,604 | B2 * | 11/2006 | Chadani et al. | 399/90 |
| 7,155,141 | B2 * | 12/2006 | Sato et al. | 399/114 |

FOREIGN PATENT DOCUMENTS

| | | |
|---|---|---|
| JP | 05-019603 | 1/1993 |
| KR | 10-1999-0058052 | 7/1999 |
| KR | 10-2007-0078519 | 8/2007 |

OTHER PUBLICATIONS

English Abstract of JP-05-019603.
Machine English language translation of JP-05-019603.
English Abstract of KR-100238145 B1.
English Abstract of KR-10-2007-0078519.

* cited by examiner

*Primary Examiner* — Hoan Tran
(74) *Attorney, Agent, or Firm* — Stanzione & Kim, LLP

(57) ABSTRACT

An image forming apparatus in which an exposing unit is mounted on a cover unit for improved space utilization. The image forming apparatus includes a body, a plurality of developing units arranged in the body along vertical direction of the body, a cover unit that opens or closes a side of the body an exposing unit provided at the cover unit so as to move in association with the closing or opening movement of the cover unit. The image forming apparatus may also include an engagement member to limit the movement of the exposing unit and a shutter unit to selectively open an optical path of the exposing unit upon closure of the cover unit.

20 Claims, 7 Drawing Sheets

IMAGE FORMING APPARATUS

CROSS-REFERENCE TO RELATED APPLICATION

This application claims the benefit of Korean Patent Application No. 10-2008-0057391, filed on Jun. 18, 2008 in the Korean Intellectual Property Office, the disclosure of which is incorporated herein by reference.

TECHNICAL FIELD

The present invention relates to an image forming apparatus, and, more particularly, to a reduced-size image forming apparatus.

BACKGROUND OF RELATED ART

An image forming apparatus is an apparatus to print an image on a printing medium, for example, sheet(s) of paper, according to input image signals. Non-limiting examples of the image forming apparatus may include, e.g., printers, copiers, facsimiles, devices combining one or more functions of the foregoing devices, and the like.

An electro-photographic type image forming apparatus, as a non-limiting example of an image forming apparatus, includes an exposing unit, an image carrier, a developing unit, etc. The exposing unit irradiates light to the image carrier charged with a predetermined electric potential, to form an electrostatic latent image on a surface of the image carrier. The developing unit feeds developer, e.g., toner, to the image carrier, on which the electrostatic latent image is formed, to form a visible image. Once formed, the visible image is transferred from the image carrier onto a printing medium, and is fixed on the printing medium, thus completing the printing of the image.

The image forming apparatus may be classified, on the basis of a printing method, into a multi-pass type and a single-pass type. The multi-pass type has a simple configuration and can achieve a reduced product size, but suffers from a slower printing speed in the case of color printing because it must sequentially repeat the transfer of developer as many times as the number of developer colors being employed. On the other hand, a single-pass type, which is also often referred to as a tandem type, transfers different colors of developers simultaneously, and thus can maintain the same printing speed as black-and-white printing even in the case of color printing. A tandem type image forming apparatus however must include essentially the same number of components associated with the developing an image, such as, e.g., an exposing unit, image carrier and developing unit, as the number of developer of different color being employed in order to transfer developers simultaneously.

Due to the volume of the many exposing unit and the corresponding number of image carriers, the conventional image forming apparatus has an increased overall product size. The conventional image forming apparatus further has an increased overall height because the exposing unit is typically arranged in the lower region of the image forming apparatus, where, for example, a paper feeding device to store and feed printing media is also arranged. This arrangement makes it difficult to design the exposing unit so as not to interfere with the paper feeding device, etc. Furthermore, even if the exposing unit is designed to be sufficiently spaced apart from the paper feeding device, for example, to avoid interferences therebewteen during operation, this may result in a less efficient space utilization. Improved space utilization in image forming apparatuses is thus desirable.

SUMMARY OF THE DISCLOSURE

In accordance with an aspect of the present disclosure, an image forming apparatus may comprise a body having an access opening on one side of the body; a plurality of developing units supported in the body, the plurality of developing units being arranged along a vertical direction of the body; a cover unit moveable between an open position, in which the access opening is open, and a closed position, in which the access opening is closed; an exposing unit supported on the cover unit so as to move toward and away from the body in association with the cover unit; an engagement member unit configured to limit movement of the exposing unit; and a shutter unit configured to selectively open an optical path between the exposing unit and one or more of the plurality of developing units based on a position of the cover unit in relation to the body.

The engagement member unit may include at least one body engagement member provided at the body; and at least one exposing unit engagement member provided at the exposing unit to correspondingly engage with the at least one body engagement member when the cover unit is in the closed position.

A first elastic member may be provided between the exposing unit and the cover unit. The first elastic member may be configured to exert a pressing force on the exposing unit toward the body so as to bias the exposing unit engagement member to move toward the body engagement member.

The exposing unit may be supported on an inner surface the cover unit in relation to the body. The exposing unit may comprise at least one light window, through which light passes. The at least one light window may extend parallel to a longitudinal direction of an image carrier of a respective corresponding one of the plurality of developing units.

The engagement member unit may comprise at least one body engagement member to guide the exposing unit into an engaged position, in which the exposing member is engaged with the body. The shutter unit may comprise a shutter engagement member configured to engage the body engagement member; a shutter member to move in association with the shutter engagement member, the shutter member having a slit corresponding to the optical path; and a second elastic member configured to elastically bias the shutter.

The shutter engagement member may include a sloped surface that comes into contact with the body engagement member so as to allow vertical sliding movement of the shutter.

The image forming apparatus may further comprise a shock-absorbing unit provided between the cover unit and the body to absorb shock generated during movement of the cover unit between the open and closed position.

The shock-absorbing unit may include a damper body provided at the body; and a damper link configured to connect the damper body to the cover unit.

The image forming apparatus may further comprise a sensor to sense whether the cover unit is in the open position or in the closed based on an operation of the damper link.

The cover unit may include an outer cover defining an outer appearance of the cover unit; and an inner cover disposed inside the outer cover, the exposing unit being mounted on the inner cover.

The inner cover may be supported by a shock-absorbing unit provided to absorb shock generated during movement of the cover unit between the open and closed position.

According to another aspect, an image forming apparatus may include a body having an access opening on one side of the body; a plurality of developing units supported in the body, the plurality of developing units being arranged along a vertical direction of the body; a cover unit moveable between an open position, in which the access opening is open, and a closed position, in which the access opening is closed; an exposing unit supported on the cover unit so as to move toward and away from the body in association with the cover unit; an engagement member unit configured to limit a movement of the exposing unit; and a shock-absorbing unit provided between the cover unit and the body, the shock absorbing unit absorbing shock generated during movement of the cover unit between the open and closed position.

The engagement member may include one or more body engagement members provided at the body; and at least one exposing unit engagement member provided at the exposing unit to correspondingly engage with the at least one of the one or more body engagement member when the cover unit is in the closed position.

The at least one exposing unit engagement member may include a first exposing unit engagement member configured to come into contact with a first one of the one or more body engagement members so as to limit vertical movement of the exposing unit; and a second exposing unit engagement member configured to come into contact with a second one of the one or more body engagement members so as to limit lateral movement of the exposing unit.

The image forming apparatus may further comprise an elastic member configured to exert an elastic force on the at least one exposing unit with so as to bias the at least one exposing unit toward a corresponding one of the one or more body engagement members.

The cover unit may have disposed thereon a leading guide configured to limit lateral movement of the exposing unit.

The image forming apparatus may further comprise a shutter unit configured to selectively open an optical path between the exposing unit and one or more of the plurality of developing units based on a position of the cover unit in relation to the body.

According to yet another aspect, an image forming apparatus may comprise a body supporting therein a plurality of developing units arranged along a vertical direction, the body having an access opening on one side of the body; a cover unit moveable between an open position in which the access opening is open, and a closed position, in which the access opening is closed; and an exposing unit supported on the cover unit so as to move toward and away from the body in association with the movement of the cover unit.

The image forming apparatus may further comprise a shutter unit comprising a shutter member having formed thereon a slit corresponding to a light window of the exposing unit, through which a light exits from the exposing unit. The shutter member may be configured to slidably move vertically across the light window so as to change a position of the slit relative to the light window.

The body may be provided with a body engagement member to guide the exposing unit into an intended operational position within the body. The body engagement member may be in an engaging contact with an exposing unit engagement member provided at the exposing unit when the cover unit is in the closed position.

BRIEF DESCRIPTION OF THE DRAWINGS

Various aspects and advantages of the embodiments of the present disclosure will become apparent and more readily appreciated from the following description of the embodiments, taken in conjunction with the accompanying drawings, of which.

DETAILED DESCRIPTION OF SEVERAL EMBODIMENTS

Figure 1:
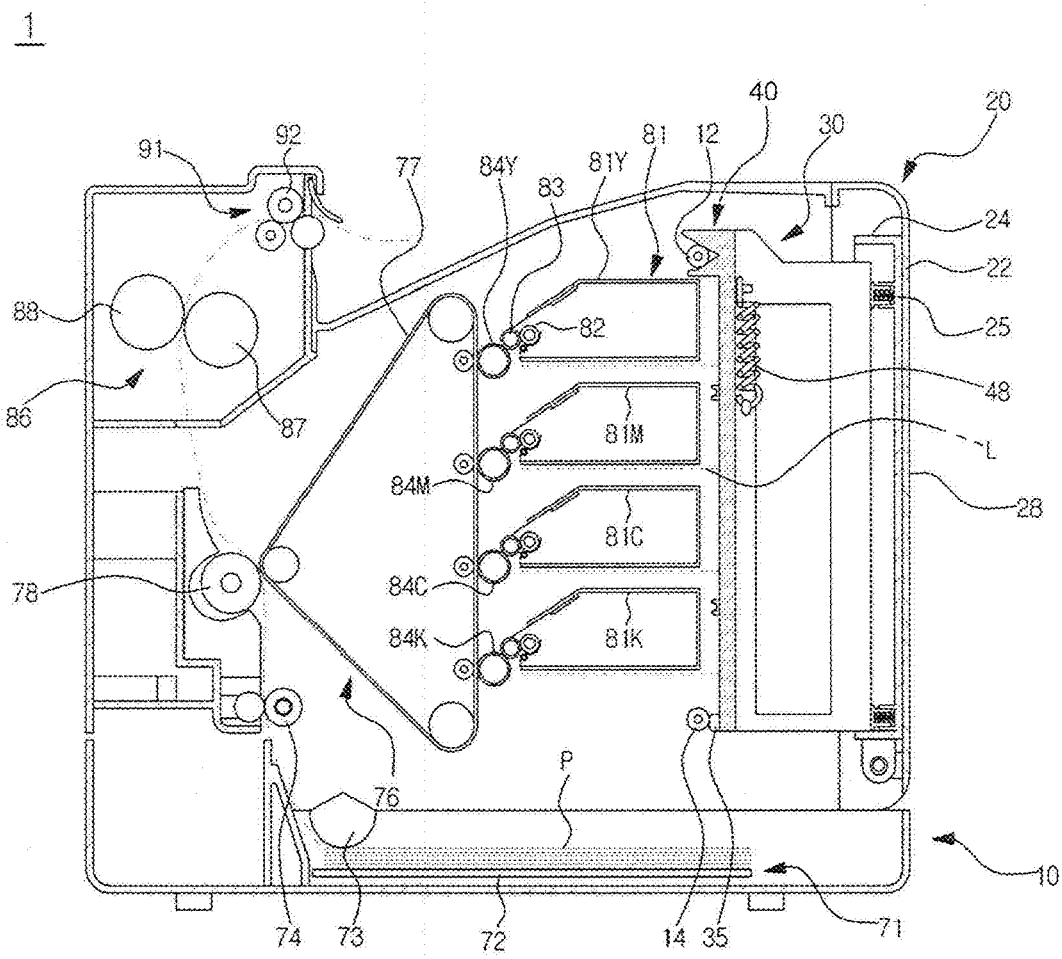
FIG. 1 is a sectional view illustrating an image forming apparatus in accordance with an embodiment of the present invention.

Several embodiments will now be described more fully with reference to the accompanying drawings, in which like reference numerals refer to like elements throughout.

Figure 2:
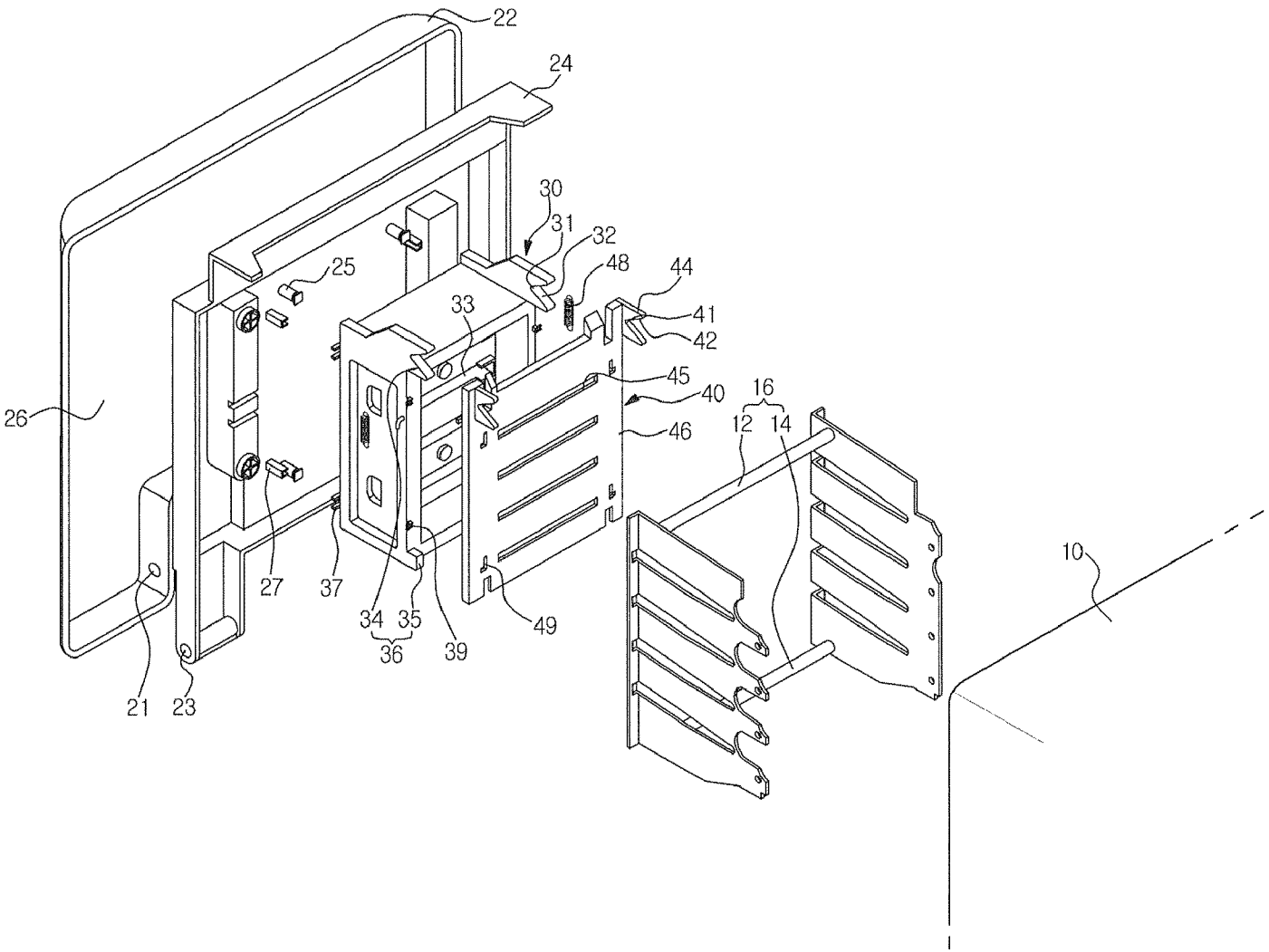
FIG. 2 is an exploded perspective view illustrating portions associated with a cover unit and a shutter unit provided in the image forming apparatus shown in FIG. 1.

FIG. 1 is a sectional view illustrating an image forming apparatus in accordance with an embodiment of the present disclosure, and FIG. 2 is an exploded perspective view illustrating portions of the image forming apparatus shown in FIG. 1 associated with a cover unit and a shutter unit.

As shown in the drawings, the image forming apparatus 1 in accordance with an embodiment may include a variety of devices, used to form an image, including a paper feeding device 71, a cover unit 20 to open or close one side of a body 10, an exposing unit 30 provided at an inner surface of the cover unit 20, a shutter unit 40 to open or close light windows 33 of the exposing unit 30, and a shock-absorbing unit 50 (FIG. 3) to absorb shock generated upon opening/closing operations of the cover unit 20.

The paper feeding device 71 includes a tray 72 in which a supply of printing media P may be loaded, and a pickup roller 73 to pick up the printing medium P loaded in the tray 72 sheet by sheet. The printing medium P, picked-up by the pickup roller 73, is delivered to a transfer device 76 by a delivery roller 74.

The transfer device 76 may include an intermediate transfer member 77 and a transfer roller 78. While for the purpose of illustration, according to an embodiment, an image forming apparatus 1 using a belt type intermediate transfer member 77 is shown in FIG. 1, the intermediate transfer member may take other forms, such as, for example, a drum or the like. A plurality of image carriers 84Y, 84M, 84C and 84K may be arranged in contact with the intermediate transfer member 77 such that visible images formed on the image carriers 84Y, 84M, 84C and 84K are transferred to the intermediate transfer member 77, forming an overlapped color image. The resulting overlapped color image is transferred to the printing medium P while passing through between the intermediate transfer member 77 and the transfer roller 78. The printing medium P, to which the image is transferred while passing through the transfer device 76, is fed to a fixing device 86.

The fixing device 86 may include a heating roller 87 and a press roller 88. The color image transferred to the printing medium P may be fixed to the printing medium P by heat and pressure while the printing medium P passes between the heating roller 87 and the press roller 88.

A discharge device 91 includes a paper discharge roller 92. The printing medium P, having passed through the fixing device 86, is discharged from the image forming apparatus I by the paper discharge roller 92.

The cover unit 20 is provided at one side of the body 10. If necessary, a user can open the cover unit 20, for exchange and repair of a variety of internal parts of the image forming apparatus 1. The cover unit 20 prevents contaminants such as dust, etc. from entering the body 10 and primarily absorbs exterior shock, etc. to thereby protect the variety of parts received in the body 10. The cover unit 20 is divided into an outer cover 22 defining an outer appearance of the body 10 and an inner cover 24 to which the exposing unit 30 may be mounted.

The outer cover 22 is visible from the outside in a state wherein the cover unit 20 closes an opening perforated in one side of the body 10. The outer cover 22 may be formed with a coupling portion (not shown) to be caught by and coupled with the body 10 and a handle (not shown) to allow the user to pull or push the outer cover 22 so as to easily attach or detach the outer cover 22 to or from the body 10. Meanwhile, in the case where a variety of structures are disposed on an inner surface 26 of the outer cover 22, the outer cover 22 may confront a minute shrinkage difference between a region provided with the structures and the remaining region during injection molding thereof. The shrinkage difference has an effect on an outer surface 28 of the outer cover 22, deteriorating the outward appearance of the outer surface 28 due to an uneven surface, etc. According to an embodiment, the outer cover 22 and inner cover 24 of the cover unit 20 may be molded individually, and the exposing unit 30 may be mounted to the inner cover 24. A variety of structures for attachment of the exposing unit 30 are provided at the inner cover 24 and therefore, the outer cover 22 has no additional structure. Providing no structure on the inner surface 26 of the outer cover 22 may assure substantially uniform shrinkage of the outer cover 22 during injection molding, an may mitigate some of the above described problems associated with non-uniform shrinkage.

The inner cover 24 is provided inside the outer cover 22. According to an embodiment, the outer cover 22 may be perforated with first holes 21, and the inner cover 24 may be perforated with second holes 23 to communicate with the first holes 21. The inner and outer covers 24 and 22 may be connected to the body 10 by rotating shafts (not shown) inserted through the first and second holes 21 and 23. The inner and outer covers 24 and 22 may rotate about the rotating shafts (not shown) to open or close the opening of the body 10. The inner cover 24 may be provided with the first elastic members 25 and leading guides 27 to prevent oscillation of the exposing unit 30.

The first elastic members 25 may be provided at the inner cover 24, to press the exposing unit 30 toward body engagement members 16 provided at the body 10. The first elastic members 25 may be, e.g., springs, to apply an elastic force to, for example, four positions on a rear surface of the exposing unit 30. The exposing unit 30 is brought into close contact with the body engagement members 16 as being pressed by the first elastic members 25. In a state wherein the exposing unit 30 comes into close contact with the body engagement members 16, even if vibrations occur, for example, by operation of the image forming apparatus 1, the exposing unit 30 may remain substantially in the proper position, and is less likely to be shaken, thus achieving substantial uniformity in print quality.

The leading guides 27 may be fitted to protruding guides 37, which may be provided at four positions near corners of the exposing unit 30, to allow forward/rearward movement of the exposing unit 30. With the leading guides 27 fitted to the protruding guides 37 guide movement of the exposing unit 30, the exposing unit 30 may be movable forward or rearward toward or away from the body engagement members 16 depending upon the elastic force received from the first elastic members 25.

The exposing unit 30 is supported on the inner cover 24. The exposing unit 30 disposed at the inner cover 24 is attached to or detached from the body 10 with closing or opening of the inner cover 24. The exposing unit 30 incorporates a scanning optical system (not shown) to generate light L. The light L generated from the scanning optical system (not shown) is introduced into the respective image carriers 84Y, 84M, 84C and 84K through the light windows 33. In the tandem type image forming apparatus 1 in accordance with an embodiment, a plurality of developing units 81Y, 81M, 81C and 81K may be arranged vertically, and may be provided with the image carriers 84Y, 84M, 84C and 84K, respectively. Each of the developing units 81Y, 81M. 81C or 81 K may be provided with a feeding roller 82 and a developing roller 83, to feed and apply developer to the corresponding image carrier 84Y, 84M, 84C or 84K. The image carriers 84Y, 84M, 84C and 84K may be photosensitive members. The light L, introduced into the respective image carriers 84Y, 84M, 84C and 84K, form photosensitive electrostatic latent images on surfaces of the image carriers 84Y, 84M, 84C and 84K. The light windows 33 of the exposing unit 30 are arranged parallel to the longitudinal direction of the respective image carriers 84Y, 84M, 84C and 84K, so as to correspond to the image carriers 84Y, 84M, 84C and 84K, respectively. According to the embodiment, the large-volume exposing unit 30 is attached to one side of the image forming apparatus 1, and therefore, as compared to the case where the exposing unit 30 is provided at the bottom of the image forming apparatus 1, the image forming apparatus 1 may have a reduced height. Furthermore, by mounting the exposing unit 30 in a relatively empty side region rather than a complex lower region incorporating the tray 72, etc., simpler design and improved space utility can be accomplished. Accordingly, reducing the overall size of the image forming apparatus 1 is possible.

The exposing unit 30 has exposing unit engagement members 36 protruding outward therefrom to correspond to the body engagement members 16. It is important for the exposing unit 30 to irradiate the light L to the desired positions on the image carriers 84Y, 84M, 84C and 84K with sufficient accuracy. The fact however that the exposing unit 30 is disposed at the cover unit 20 so as to be pivotally rotated together with the cover unit 20 may make it difficult for the exposing unit 30 to be coupled to the body 10 in the proper position. To that end, the exposing unit engagement members 36 guides the exposing unit 30 to the coupling position during coupling operation of the exposing unit 30, and after completion of the coupling of the exposing unit 30, allow the exposing unit 30 to be fixed in the desired engaged position. The exposing unit engagement members 36 are divided into first exposing unit engagement members 34 to guide a vertical position of the exposing unit 30 and second exposing unit engagement members 35 to guide the front-and-rear position of the exposing unit 30.

The first exposing unit engagement members 34 are positioned to correspond to a first body engagement member 12 of the body engagement members 16. Each first exposing unit engagement member 34 has a pair of tapered upper and lower slopes 32 defining a 90°-rotated V-shape such that a recess 31 is formed at a position where the two slopes 32 converge. The first body engagement member 12 is coupled to the first exposing unit engagement member 34 along the slopes 32 provided at the first exposing unit engagement member 34. Specifically, when the first body engagement member 12 begins to be brought into contact with the first exposing unit engagement member 34, the first body engagement member 12 first comes into contact with the slopes 32. Accordingly, the first body engagement member 12 in contact with the slopes 32 moves along the tapered slopes 32, and becomes seated in the recess 31. When the first body engagement member 12 is properly seated in the recess 3 1, the exposing unit 30 is located in the correct vertical position. As described above, the exposing unit 30 is pressed forward by the first elastic members 25. Accordingly, once the first body engagement member 12 is located in the recess 31, the exposing unit 30 does not deviate from the right vertical position even when vibrated, etc. until the user releases the coupling of the cover unit 20. That is, the user can place the exposing unit 30 in the right vertical position by simply coupling the cover unit 20 to the body 10.

The second exposing unit engagement members 35 correspond to a second body engagement member 14 of the body engagement members 16. Unlike the first exposing unit engagement members 34, the second exposing unit engagement members 35 have a flat contact portion to come into contact with the second body engagement member 14. Although the second exposing unit engagement members 35 may have the slopes 32 in the same manner as the first exposing unit engagement members 34, in consideration of the cover unit 20 being pivotally rotated about the rotating shafts (not shown) and coupled to the body 10, it can be appreciated that providing the second exposing unit engagement members 35 with flat front surfaces advantageously achieves easier coupling. As described above, the exposing unit 30 is pressed forward by the first elastic members 25. Accordingly, when the second exposing unit engagement members 35 come into contact with the second body engagement member 14, the exposing unit 32 is not shaken forward or rearward even when vibrated, etc.

The shutter unit 40 serves to open or close the light windows 33 of the exposing unit 30 according to opening/closing operations of the cover unit 20. When the exposing unit 30 is exposed to the outside as the inner cover 24 is open, there is a likelihood of the light windows 33 being exposed to a variety of contaminants. Contamination of the light windows 33 may, for example, cause scattering of the light L irradiated from the exposing unit 30, resulting in deterioration of print quality. Further, if the image forming apparatus 1 is operated in a state wherein the exposing unit 30 is exposed to the outside, the light L irradiated from the exposing unit 30 may potentially cause an eye injury. The shutter unit 40 provided in front of the exposing unit 30 closes the light windows 33 upon opening of the cover unit 20, thereby preventing the above-described adverse situations. Specifically, if the cover unit 20 is opened away from the body 10, the shutter unit 40 slidably moves to close the light windows 33. Then, if the cover unit 20 is closed to the body 10, the shutter unit 40 slidably moves in an opposite direction to open the light windows 33. The shutter unit 40 includes shutter engagement members 44, a shutter 46 formed with slits 45 to correspond to the respective light windows 33, and second elastic members 48 to elastically bias the shutter 46.

The shutter engagement members 44 are guided by the first body engagement member 12 and enable sliding movement of the shutter unit 40. The shutter engagement members 44 protrude outward from the shutter unit 40. Accordingly, if the exposing unit 30, a front surface Of which is coupled with the shutter unit 40, approaches the body 10, the shutter engagement members 44 are the first to come into contact with the first body engagement member 16 provided at the body 10. Similar to the first exposing unit engagement member 34, each shutter engagement member 44 has slopes 42 and a recess 41. The slopes 42 and the recess 41 are defined at a contact portion of the shutter engagement member 44 to come into contact with the first body engagement member 12 and therefore, the slopes 42 are brought into contact with the first body engagement member 12 during coupling of the shutter engagement member 44 to the first body engagement member 12. Thereby, the shutter engagement member 44 is moved upward by the first body engagement member 12.

The shutter 46 is provided to close a substantial part of the front surface of the exposing unit 30. The shutter 46 closes the light windows 33 when the shutter engagement members 44 are not coupled to the first body engagement member 12, and opens the light windows 33 when the shutter engagement members 44 are coupled to the first body engagement member 12. The shutter 46 moves in linkage with the shutter engagement members 44. The shutter 46 is formed with the slits 45 and sliding holes 49, which prevent the shutter 46 from being separated from the exposing unit 30.

The slits 45 allow the light windows 33 to be open when the exposing unit 30 is coupled to the body 10. The number of the slits 45 corresponds to the number of the light windows 33. The slits 45 are narrow longitudinally extending holes. If the exposing unit 30 is separated from the body 10, the shutter 46 slidably moves downward. With downward movement of the shutter 46, the slits 45 deviate from the light windows 33 and consequently, the light L emitted from the exposing unit 30 is intercepted by the shutter 46 so as not to be emitted to the outside. On the other hand, if the exposing unit 30 is coupled to the body 10, the shutter 46 slidably moves upward to communicate the light windows 33 with the slits 45, allowing the light L emitted from the exposing unit 30 to arrive at the image carriers 84Y, 84M, 84C and 84K.

The sliding holes 49 are coupling holes perforated in the shutter 46. Guiding protrusions 39 of the exposing unit 30 are inserted into the sliding holes 49. With coupling of the sliding holes 49 perforated in four corners of the shutter 46 and the guiding protrusions 39 protruding from four corners of the exposing unit 30, the shutter 46 is coupled to the front surface of the exposing unit 30. During when the coupling is maintained, the guiding protrusions 39 slidably move along the sliding holes 49.

The second elastic members 48 are coupled between the shutter 46 and the exposing unit 30. The second elastic members 48, coupled between the shutter 46 and the exposing unit 30, elastically bias the shutter 46 to facilitate downward movement of the shutter 46. Accordingly, when the shutter engagement members 44 are not coupled to the first body engagement member 12, the shutter 46 is kept in the moved downward state. When the shutter 46 is in the moved downward state, the slits 45 becomes misaligned with, and thus cover, the light windows 33 to prevent light I., from being emitted to the outside. The second elastic members 48 may be arranged at left and right positions of the shutter 46.

Figure 3:
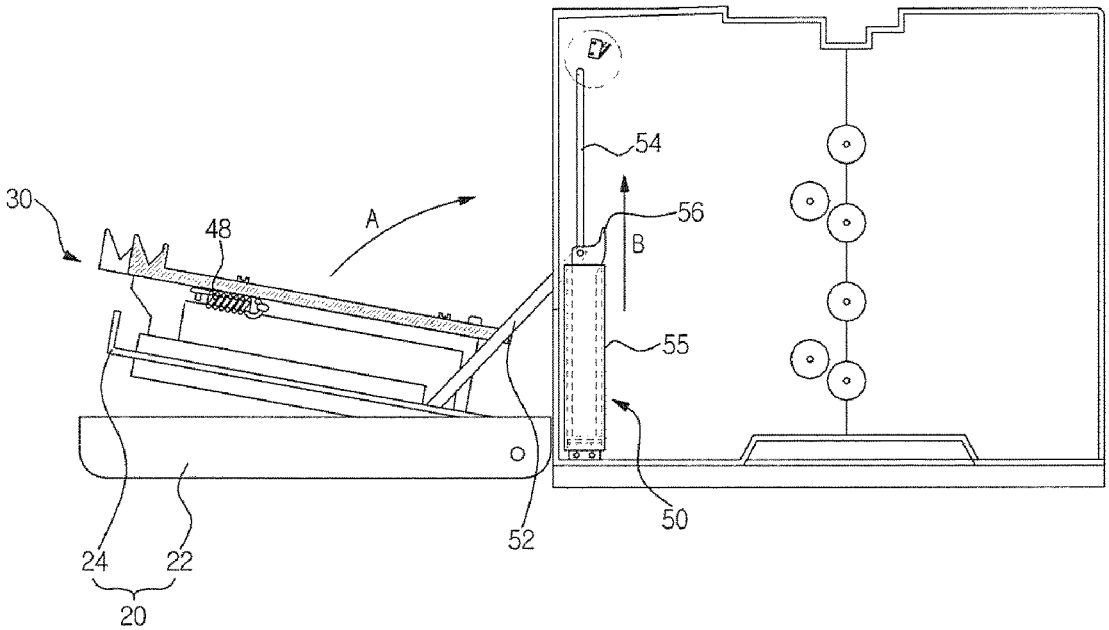
FIGS. 3 and 4 are a view illustrating a shock-absorbing unit provided in the image forming apparatus shown in FIG. 1.
Figure 4:
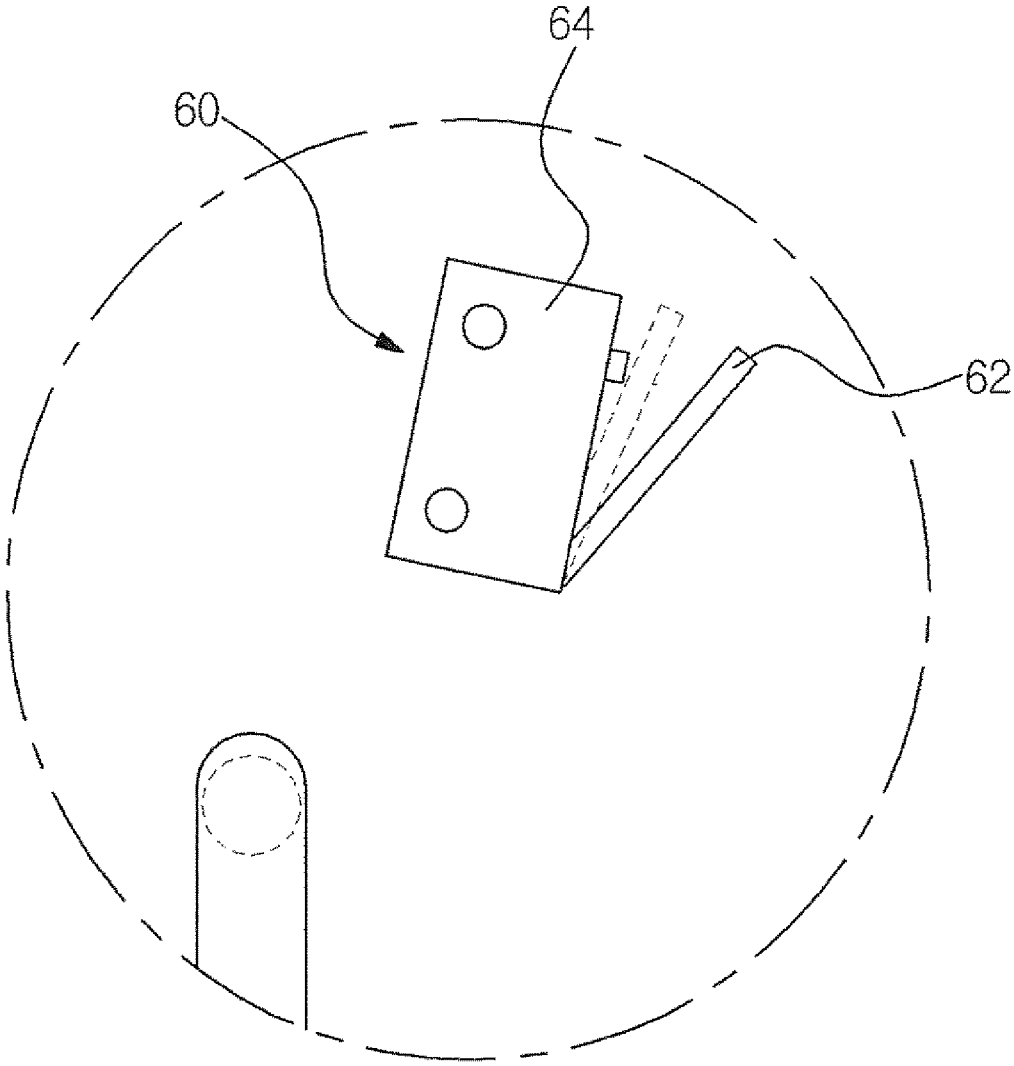

Hereinafter, embodiments relating to the shock-absorbing unit 50 and a sensor 60 will be described with reference to FIGS. 3 and 4. FIG. 3 is a view illustrating the shock-absorbing unit that may be employed in the image forming apparatus shown in FIG. 1.

The shock-absorbing unit 50 is provided between the cover unit 20 and the body 10, to absorb shock generated upon opening/closing operations of the cover unit 20. The exposing unit 30 incorporates precision optical parts, such as, e.g., the scanning optical system (not shown) etc. which may be effected by repeated shock and vibration. When the exposing unit 30 is disposed at the cover unit 20 vibration may be repeatedly transmitted to the exposing unit 30 due to repeated opening/closing of the cover unit 20. The shock-absorbing unit 50 may reduce the generation of vibration due to opening/closing operations of the cover unit 20. The shock-absorbing unit 50 is provided between the body 10 and the cover unit 20, more particularly, the inner cover 24 at which the exposing unit 30 is disposed. Therefore, when the user opens the cover unit 20, the outer cover 22, which is not supported by the shock-absorbing unit 50, naturally moves to the open position, but the inner cover 24 is slowly opened by damping operation of the shock-absorbing unit 50. As the inner cover 24 is opened slowly, only a small amount of shock may be transmitted to the exposing unit 30 upon opening of the cover unit 20. Similarly, when the user closes the cover unit 20, damping operation of the shock-absorbing unit 50 prevents rapid closing of the inner cover 24. Accordingly, collision shock between the cover unit 20 and the body 10 is reduced. The shock-absorbing unit 50 and the inner cover 24 are connected to each other via inner cover links 52. The inner cover links 52 move vertically along link grooves 54 formed at the body 10. The sensor 60 is provided at a distal end of the shock-absorbing unit 50.

The sensor 60 senses whether the cover unit 20 is opened or closed, on the basis of operation of the inner cover links 52. For example, the exposing unit 30 must not be operated in an opened state of the cover unit 20. To this end, the position observation sensor 60 senses whether the cover unit 20 is opened or closed. If the cover unit 20 moves from the open position toward the closed position as indicated by the arrow A, a damper link 56 in the damper body 55 of the shock-absorbing unit 50 moves upward as indicated by the arrow B. Once the cover unit 20 is completely closed, the damper link 56 presses a sensing plate 62 of the sensor 60, causing the sensing plate 62 to come into contact with a sensor body 64. If the sensing plate 62 comes into contact with the sensor body 64, an electric signal may be transmitted to a control unit (not shown) to inform that the cover unit 20 is closed.

Now, the operation of the image forming apparatus having the configurations of above-described embodiments will be described with reference to FIGS. 5 to 7.

Figure 5:
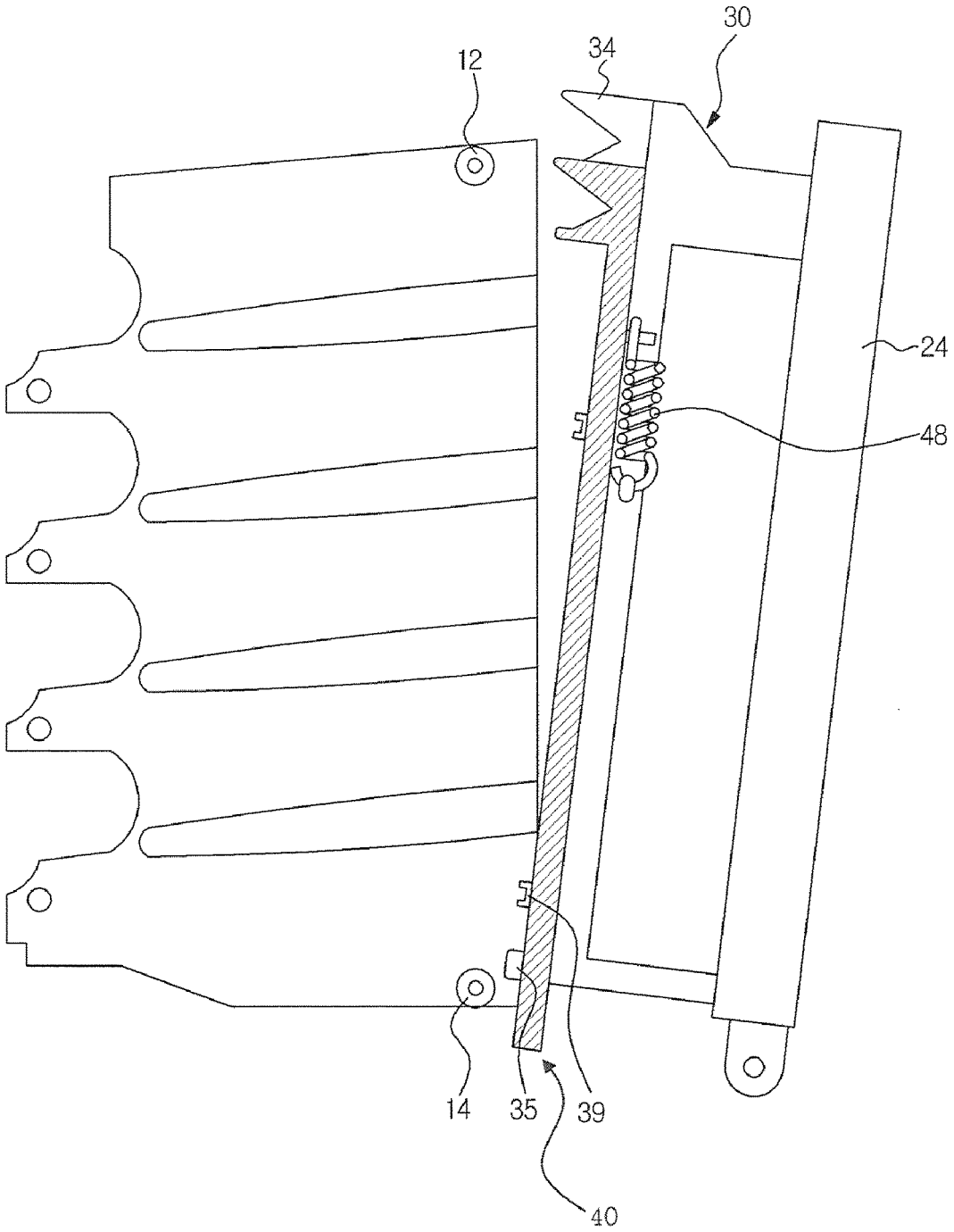
FIGS. 5 to 7 are side views illustrating a coupling procedure of the cover unit shown in FIG. 1.
Figure 6:
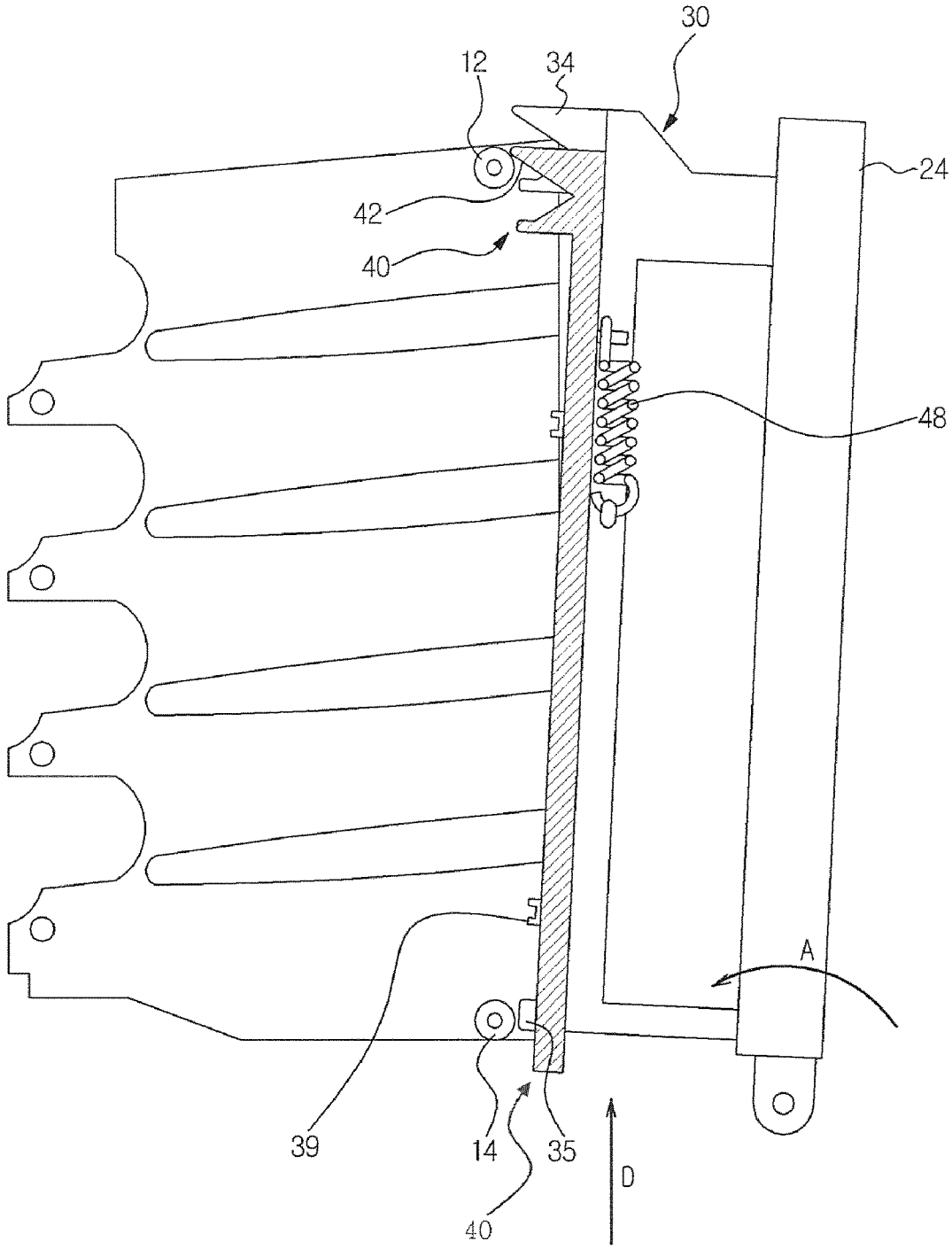
Figure 7:
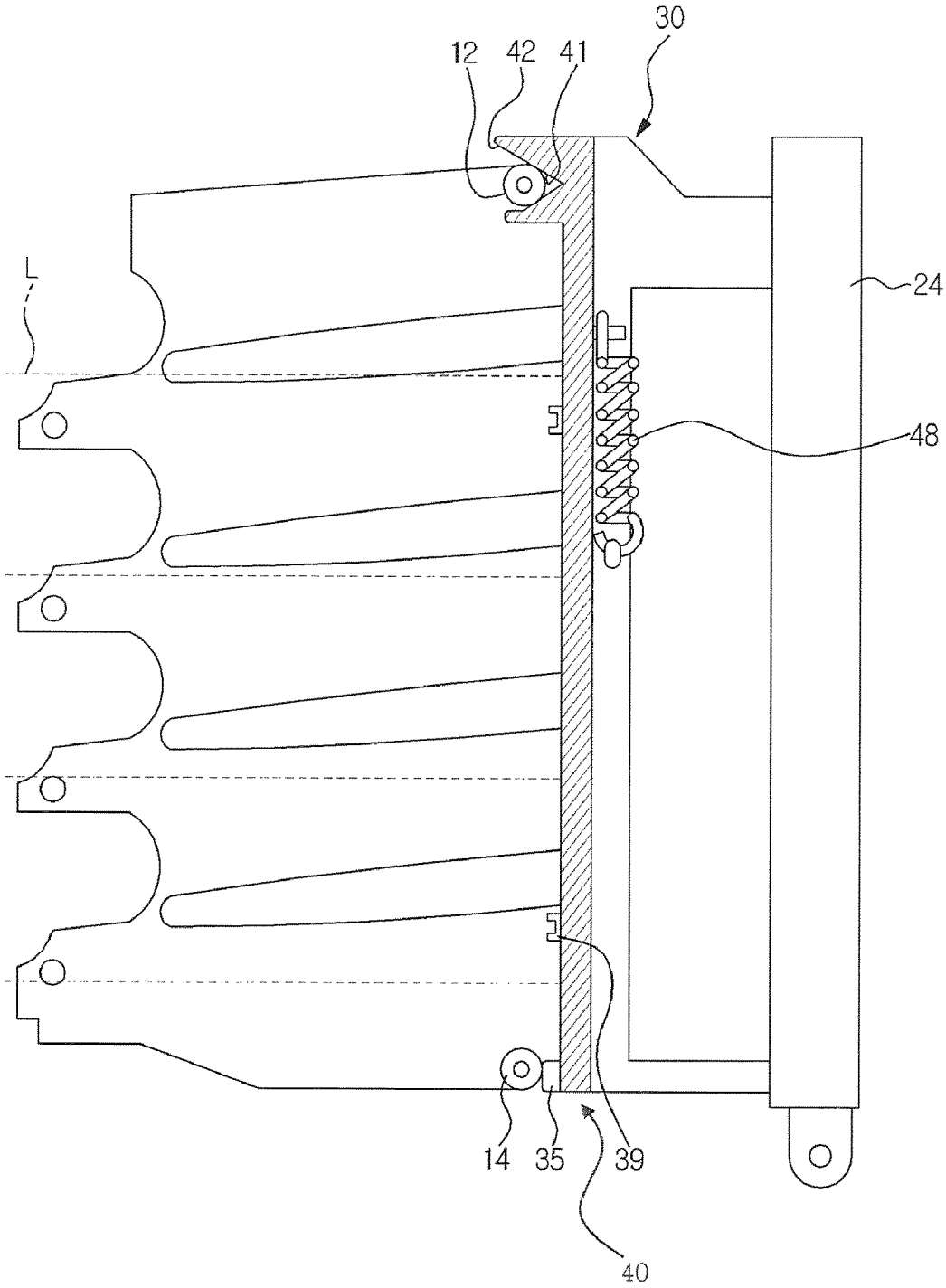

FIGS. 5 to 7 are side views illustrating an example of the coupling procedure of the cover unit shown in FIG. 1.

As shown in FIG. 5, in the case where the inner cover 24 is in the open state, the shutter unit 40 is in the downward position. Specifically, the shutter unit 40 is kept in a downward position by elasticity of the second elastic members 48 provided between the exposing unit 30 and the shutter unit 40. In this state wherein the shutter unit 40 is in the downward position, the slits 45 (FIG. 2) of the shutter unit 40 and the light windows 33 (FIG. 2) of the exposing unit 30 are not in alignment with each other. Accordingly, there is a reduced likelihood of the light windows 33 (FIG. 2) being contaminated by a variety of contaminants, and of the light L (FIG. 1) generated from the exposing unit 30 being emitted to the outside past the shutter unit 40.

As shown in FIG. 6, as the inner cover 24 moves in the cover coupling direction A, the slopes 42 of the shutter unit 40 begin to come into contact with the first body engagement member 12. If the inner cover 24 is further pivotally rotated inward in the cover coupling direction A after the slopes 42 come into contact with the first body engagement member 12, the first body engagement member 12 presses the slopes 42 upward. As the slopes 42 are pressed by the first body engagement member 12, the shutter unit 40 begins to slidably move in the opening direction as represented by the arrow D overcoming the elastic force of the second elastic members 48. The guiding protrusions 39 of the exposing unit 30 are fitted into the sliding holes 49 (FIG. 2) of the shutter unit 40, guiding the shutter unit 40 to slide along only in the vertical direction.

As shown in FIG. 7, the first body engagement member 12 is completely seated in the recess 41 upon completion of the coupling of the inner cover 24. When the first body engagement member 12 is located in the recess 41, the slits 45 (FIG. 2) of the shutter unit 40 communicate with the light windows 33 (FIG. 2) of the exposing unit 30. Accordingly, the light L generated from the exposing unit 30 can be emitted to the outside. Simultaneously with the first body engagement member 12 being seated in the recess 41, the first body engagement member 12 is coupled to the first exposing unit engagement members 34 (FIG. 6) of the exposing unit 30, limiting the vertical movement of the exposing unit 30. In addition, the second body engagement member 14 is coupled to the second exposing unit engagement members 35, limiting forward/rearward movement of the exposing unit 30.

As described above, the exposing unit 30 is mounted to the cover unit 20 provided at one side of the body 10, resulting better space utilization in the image forming apparatus 1. With the pivotal rotation of the cover unit 20, the shutter unit 40 can be operated to open or close the light windows 33, and the exposing unit 30 may be guided into a proper operational position.

In the above-described embodiments, although, as an illustrative example, the cover unit consisting of the inner cover and the outer cover is described, alternative embodiments implemented with a single cover unit or three or more cover units are also possible.

In the above-described embodiments, a tandem type image forming apparatus is illustrated, the embodiment can be implemented with respect to other types of image forming apparatuses e.g., a single pass type.

In the above-described embodiments, although a contact-operated sensor for detecting the status of the cover is described, the sensor may alternatively be of any other type, e.g., an optical sensor., or the like.

In the above-described embodiments, although the elastic members in the form of springs are illustrated, other embodiments that employ other types of elastic member(s), e.g., elastic members made of rubber or other elastic materials, are also contemplated.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising:

a body having an access opening on one side of the body;

a plurality of developing units supported in the body, the plurality of developing units being arranged along a vertical direction of the body;

a cover unit moveable between an open position, in which the access opening is open, and a closed position, in which the access opening is closed;

an exposing unit supported on the cover unit so as to move toward and away from the body in association with the cover unit;

an engagement member unit configured to limit movement of the exposing unit; and a shutter unit configured to selectively open an optical path between the exposing unit and one or more of the plurality of developing units based on a position of the cover unit in relation to the body.

2. The image forming apparatus according to claim 1, wherein the engagement member unit includes:

at least one body engagement member provided at the body; and at least one exposing unit engagement member provided at the exposing unit to correspondingly engage with the at least one body engagement member when the cover unit is in the closed position.

3. The image forming apparatus according to claim 2, wherein a first elastic member is provided between the exposing unit and the cover unit, first elastic member being configured to exert a pressing force on the exposing unit toward the body so as to bias the exposing unit engagement member to move toward the body engagement member.

4. The image forming apparatus according to claim 1, wherein:

the exposing unit is supported on an inner surface the cover unit in relation to the body, and wherein the exposing unit comprises at least one light window, through which light passes, the at least one light window extending parallel to a longitudinal direction of an image carrier of a respective corresponding one of the plurality of developing units.

5. The image forming apparatus according to claim 1, wherein:

the engagement member unit comprises at least one body engagement member to guide the exposing unit into an engaged position in which the exposing member is engaged with the body; and wherein the shutter unit comprises:

a shutter engagement member configured to engage the body engagement member;

a shutter member to move in association with the shutter engagement member, the shutter member having a slit corresponding to the optical path; and a second elastic member configured to elastically bias the shutter.

6. The image forming apparatus according to claim 5, wherein the shutter engagement member includes a sloped surface that comes into contact with the body engagement member so as to allow vertical sliding movement of the shutter.

7. The image forming apparatus according to claim 1, further comprising a shock-absorbing unit provided between the cover unit and the body to absorb shock generated during movement of the cover unit between the open and closed position.

8. The image forming apparatus according to claim 7, wherein the shock-absorbing unit includes:

a damper body provided at the body; and a damper link configured to connect the damper body to the cover unit.

9. The image forming apparatus according to claim 8, further comprising a sensor to sense whether the cover unit is in the open position or in the closed based on an operation of the damper link.

10. The image forming apparatus according to claim 1, wherein the cover unit includes:

an outer cover defining an outer appearance of the cover unit; and an inner cover disposed inside the outer cover, the exposing unit being mounted on the inner cover.

11. The image forming apparatus according to claim 10, wherein the inner cover is supported by a shock-absorbing unit provided to absorb shock generated during movement of the cover unit between the open and closed position.

12. An image forming apparatus, comprising:

a body having an access opening on one side of the body;

a plurality of developing units supported in the body, the plurality of developing units being arranged along a vertical direction of the body;

a cover unit moveable between an open position, in which the access opening is open, and a closed position, in which the access opening is closed;

an exposing unit supported on the cover unit so as to move toward and away from the body in association with the cover unit;

an engagement member unit configured to limit a movement of the exposing unit; and a shock-absorbing unit provided between the cover unit and the body, the shock absorbing unit absorbing shock generated during movement of the cover unit between the open and closed position.

13. The image forming apparatus according to claim 12, wherein the engagement member includes:

one or more body engagement members provided at the body; and at least one exposing unit engagement member provided at the exposing unit to correspondingly engage with the at least one of the one or more body engagement member when the cover unit is in the closed position.

14. The image forming apparatus according to claim 13, wherein the at least one exposing unit engagement member includes:

a first exposing unit engagement member configured to come into contact with a first one of the one or more body engagement members so as to limit vertical movement of the exposing unit; and a second exposing unit engagement member configured to come into contact with a second one of the one or more body engagement members so as to limit lateral movement of the exposing unit.

15. The image forming apparatus according to claim 13, further comprising an elastic member configured to exert an elastic force on the at least one exposing unit with so as to bias the at least one exposing unit toward a corresponding one of the one or more body engagement members.

16. The image forming apparatus according to claim 12, wherein the cover unit has disposed thereon a leading guide configured to limit lateral movement of the exposing unit.

17. The image forming apparatus according to claim 12, further comprising a shutter unit configured to selectively open an optical path between the exposing unit and one or more of the plurality of developing units based on a position of the cover unit in relation to the body.

18. An image forming apparatus, comprising:

a body supporting therein a plurality of developing units arranged along a vertical direction, the body having an access opening on one side of the body;

a cover unit moveable between an open position, in which the access opening is open, and a closed position, in which the access opening is closed; and an exposing unit supported on the cover unit so as to move toward and away from the body in association with the movement of the cover unit.

19. The image forming apparatus according to claim 18, further comprising:

a shutter unit comprising a shutter member having formed thereon a slit corresponding to a light window of the exposing unit, through which a light exits from the exposing unit, the shutter member being configured to slidably move vertically across the light window so as to change a position of the slit relative to the light window.

20. The image forming apparatus according to claim 18, wherein the body is provided with a body engagement member to guide the exposing unit into an intended operational position within the body, the body engagement member being in an engaging contact with an exposing unit engagement member provided at the exposing unit when the cover unit is in the closed position.

* * * * *